United States Patent [19]

Moreau

[11] 4,023,783

[45] May 17, 1977

[54] DEGASING OF LIQUID METALS, IN PARTICULAR OF LIQUID STEEL, BY VACUUM JET

[75] Inventor: René Moreau, Voiron, France

[73] Assignee: Agence Nationale de Valorisation de la Recherche (ANVAR), Neuilly-sur-Seine, France

[22] Filed: June 18, 1975

[21] Appl. No.: 587,837

[30] Foreign Application Priority Data

June 21, 1974 France ..... 74.21569

[52] U.S. Cl. ..... 266/208; 266/237; 75/49; 164/50; 164/254; 164/147

[51] Int. Cl.[2] ..... C21C 7/10

[58] Field of Search ..... 75/49; 164/48–51, 164/61, 64, 65, 146, 147, 160, 251, 253, 254, 256, 258; 266/34 V, 207, 208, 234, 237

[56] References Cited

UNITED STATES PATENTS

| | | | |
|---|---|---|---|
| 2,085,450 | 6/1937 | Rohn | 164/254 X |
| 2,997,760 | 8/1961 | Hanks et al. | 164/50 |
| 3,061,298 | 10/1962 | Yamazoe | 266/34 V |
| 3,177,536 | 4/1965 | Schneider | 164/147 |

FOREIGN PATENTS OR APPLICATIONS

| | | | |
|---|---|---|---|
| 1,003,778 | 6/1954 | Germany | 75/49 |

*Primary Examiner*—Roy Lake
*Assistant Examiner*—Paul A. Bell
*Attorney, Agent, or Firm*—William D. Stokes

[57] ABSTRACT

The invention comprises a method for reducing the cooling of metal and the projection of metal onto the walls in the course of degasing of liquid metals by vacuum jet, which comprises establishing, in the area of the nozzle extending into the vacuum chamber and beneath said nozzle, a magnetic field tending to contract or confine the jet admitted by the nozzle into the vacuum chamber.

It further comprises an apparatus for degasing liquid metals by vacuum jet technique, comprising, around the nozzle which forms the jet between an upper ladle containing the liquid metal to be degased and the vacuum chamber containing a lower ladle or an ingot mold to receive the degased liquid metal and beneath said nozzle, a solenoid having an a.c. electric current flowing therethrough such that the electric currents induced in the liquid metal tend to contract or confine the liquid metal jet ejected from said nozzle.

10 Claims, 5 Drawing Figures

PRIOR ART

DEGASING OF LIQUID METALS, IN PARTICULAR OF LIQUID STEEL, BY VACUUM JET

BACKGROUND OF THE INVENTION

The present invention relates to vacuum-degasing of liquid metals in particular of liquid steel and, more specifically, to degasing by vacuum jet.

There are known several methods of vacuum degasing, said methods being recalled in the article by M. VERGE entitled "Tendances actuelles des procedes de degazage d'acier liquide" (Heurtey, Bulletin d'information n° 42 of March 1968) and, in particular, the method of vacuum-jet degasing according to which (FIGS. 1 and 2) the liquid steel to be degased 1, contained in a ladle 2, flows (arrows 1a) through a port 2*a* provided at the bottom thereof and is admitted through a nozzle 3 into an enclosure 4 held under vacuum (with the air being evacuated in the direction shown by arrow 5 through a port 6). The liquid jet 7 admitted into the evacuated enclosure 4 bursts to droplets 8, said droplets being collected either in a ladle, or in an ingot mold 9 in which degased steel 10 is collected.

The vacuum degasing in particular by vacuum jet of steel is used in order to improve the quality of finally obtained steel. Such a process chiefly aims to substantially reduce the hydrogen content in the liquid metal, thus preventing flaking and it is known that the presence of flakes reduces the mechanical properties, especially the life in fatigue tests, as well as the oxygen and nitrogen contents, thus reducing segregations and inclusions (the vacuum deoxidizing enabling the number of metallic quenching additions to be reduced), hence improvement of mechanical characteristics in longitudinal direction and especially in transverse direction. For certain steels, including stainless steels, the vacuum degasing allows a reduction of other gas content, e.g. of carbides present therein.

However, the known methods of vacuum casting have certain drawbacks. The metal jet escaping through port 3*a* provided in the nozzle 3 is abruptly brought to a very low pressure (which may be in the range of 1 torr, i.e. 1 mm of mercury) prevailing in the enclosure 4. There results violent boiling of liquid metals with very quick forming and growing of gas bubbles and a bursting of jet 7 which is dissociated into fine droplets having a diameter in the range of a fraction of millimeter. While this dispersion of the jet into small droplets provides a considerable exchange area between steel and air and accordingly an excellent and almost instantaneous degasing, it has however two drawbacks which limit the development of the technique of degasing by vacuum jet, viz:

on the one hand, a substantial cooling of the metal, due to the large exchange area between the metal and the thus-created rarefied atmosphere; and on the other hand, metal projections onto the walls of chamber 4 and, in the case of casting in an ingot mold, onto the walls of the latter; these projections onto the walls are cooled quicker than the bulk of the metal falling in the center of the ingot mold, and, since they have been subjected to a different thermal treatment, they originate in defects in the final ingot cast in the mold.

SUMMARY OF THE INVENTION

The present invention aims to overcome both aforesaid drawbacks (substantial cooling of the metal and projections of metal droplets onto the walls) by preventing the bursting of the jet at the outlet of nozzle 3 without suppressing the pulverization of the same. For this purpose, there is provided at the level of the nozzle and below the same a magnetic field of the type tending to contract or confine the jet.

Accordingly, the main object of the invention resides in the provision of a method for reducing the cooling of the metal and the projections of metal against the walls in the course of degasing of liquid metals by vacuum jet, which method comprises establishing, in the area of the nozzle extending into the vacuum chamber and beneath this nozzle, a magnetic field tending to contract or confine the jet admitted through the nozzle into the vacuum chamber.

A further object of the invention is to provide an apparatus for degasing liquid metals by vacuum jet, for practising the afore-said method, said apparatus comprising, around the nozzle which forms the jet between an upper ladle containing the liquid metal to be degased and the vacuum chamber containing a lower ladle or an ingot mold adapted to receive the degased liquid metal and, below said nozzle, a solenoid having an a.c. electric current flowing therethrough such that the electric currents induced in the liquid metal tend to contract the liquid metal jet ejected from said nozzle.

These and other objects, features and advantages of the invention will be better understood upon reading the following description, taken in connection with the accompanying drawing, given merely by way of an example without any intent to limitation.

DETAILED DESCRIPTION OF THE INVENTION

Figure 1:
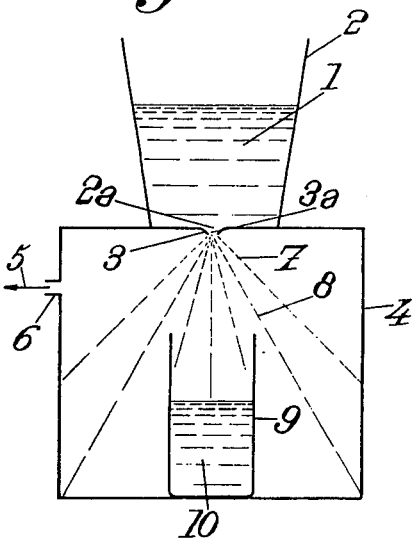
FIGS. 1 and 2, already mentioned, illustrate in diagrammatic sectional views, respectively the apparatus of degasing by vacuum jet in accordance with prior art and, on a larger scale, a detail of said apparatus, viz the nozzle and the liquid jet ejected therefrom.
Figure 3:
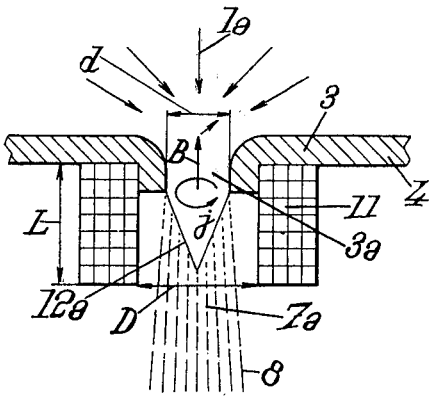
PRIOR ART Fig.3.
FIG. 3 is a further sectional view of the improvement according to the invention.

According to the invention and especially in accordance with the practical embodiment thereof considered as being the most advantageous, for instance in order to effect the vacuum jet degasing of a liquid metal, including liquid steel, the method comprises the following steps or technical equivalents thereof (FIG. 3).

There is positioned, around the nozzle 3 and beneath the same, a solenoid 11 having a.c. current flowing therethrough to produce alternative axial field of magnetic induction $\vec{B}$. Said alternative axial magnetic field produces, in the liquid metal jet, induced electric currents by means of a transformer effect, the induced currents being circular (the density of the induced current has been represented by the vector $\vec{j}$).

Figure 2:
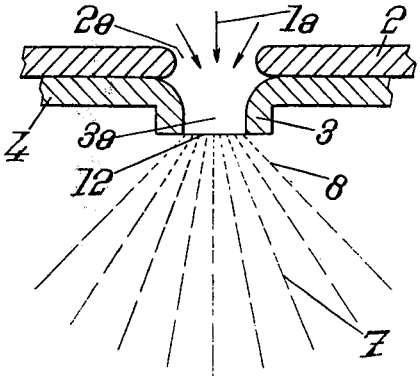

Each unit of liquid metal volume is thus subjected to a Laplace force which is equal to the vectorial product of $\vec{j}$ and $\vec{B}$; this force, perpendicular to both vectors $\vec{j}$ and $\vec{B}$, is radial and centripetal and tends accordingly to contract or confine the jet. As a result, Laplace forces acting on the entire jet tend to contract the same and to establish in the center of the jet in overpressure such that the centrifugal radial pressure forces equilibrate exactly the centripetal Laplace forces (in fact, in view of the very high inertia of the liquid, the effective values of $\vec{j}$ and $\vec{B}$ interfere in the process). Accordingly the jet becomes contracted as can be seen by the reference 7*a* in FIG. 3 instead of being very divergent as was the case with the jet 7 of the prior art (FIG. 2). Under these conditions the isobars (curves of the same pressure) are no longer right cross-sections of the jet, but substantially conical surfaces. The front of boiling of the liquid jet, which coincides with the isobar at the saturation steam pressure, is no longer a plane-section 12 (as in FIG. 2) but a nearly-conical surface 12*a* (as shown in FIG. 3).

Gas bubbles formed on these substantially conical surfaces may thus easily grow and escape outwards, without causing a bursting of the jet, while on the contrary the closed bubbles (according to the known embodiment of FIG. 2) within a right plane section, can grow and escape only by bursting the jet.

It will thus be seen that, owing to the improvements of the present invention, all the advantages of degasing by vacuum jets are preserved while the drawbacks thereof are eliminated. Indeed, since the boiling presists, the mechanism of forming the droplets is not suppressed. However, owing to the improvements provided by the invention, the droplets formed from the conical boiling front, fall into the ingot mold or the ladle by following much more rectilinear paths, as may be seen in FIG. 3 by comparison with FIG. 2, as the motion thereof is merely ballistic and only depends on the initial velocity thereof, the latter having the same vertical component both in the case of FIG. 3 and of FIG. 2, but has on the contrary a much lower radial component in the case of FIG. 3 than in the case of FIG. 2.

It is thus possible to suppress the bursting which is detrimental and to control the angle of dispersion of the jet by acting on the current applied to the solenoid 11 so as to control the internal overpressure of the jet.

By way of illustration, with a nozzle having a port diameter *d* of about 1 to 2 cm, it is possible to use a solenoid having an inner diameter D of about 4 to 6 cm and a length or height L of about 10 to 20 cm.

With respect to electrical parameters (frequency, current intensity and current power), the following remarks can be made:

1° - Frequency

It is such that the magnetic induction shall be null at the center of the liquid metal column. By equalization of the depths of penetration $$\delta = \sqrt{\frac{2}{\mu\sigma\omega}}$$

and the radius R of the column, it will be found:

$$\omega = \frac{2}{\mu\sigma R^2} \text{ or } f = \frac{1}{\omega\mu\sigma R^2}$$

with:

$\mu = 4\pi \cdot 10^{-7}$ H.m$^{-1}$ $\sigma$ = electric conductivity of metal

R = inner radius of nozzle (R = d/2)

Examples

Liquid steel:

$$\begin{cases} \sigma \text{ No. } 0.7.10^6 \text{ mho.m}^{-1} \\ R = 1 \text{ cm.} \end{cases}$$

*f No. 2500 Hz*

Liquid aluminium:

$$\begin{cases} \sigma \text{ No. } 5.10^6 \text{ mho.m}^{-1} \\ R = 1 \text{ cm.} \end{cases}$$

*f* No. 500 Hz

2° - Current

It is such that the magnetic induction created by the coil-turn between the latter and the metal, provides a sufficient overpressure, i.e. of a few mm Hg. The essential formulas are:

$$\Delta p = \frac{B^2}{2\mu}$$

$$B = \frac{\mu n I}{L}$$

wherein:

nI = Inductor ampere-turns

L = length of the coil

B = magnetic induction $\Delta p$ = caused overpressure

| nI Amp. turns | B Tesla | p N. m$^{-2}$ | mm Hg |
|---|---|---|---|
| 100 | $1.256 \cdot 10^{-3}$ | 0.627 | 0.0047 |
| 500 | $6.28 \cdot 10^{-3}$ | 17.69 | 0.118 |
| 1,000 | 0.0125 | 62.77 | 0.47 |
| 2,000 | 0.0251 | 250.67 | 1.88 |
| 3,000 | 0.0376 | 562.52 | 4.22 |
| 4,000 | 0.0502 | 1,002.7 | 7.52 |
| 5,000 | 0.0628 | 1,569 | 11.76 |
| 6,000 | 0.0754 | 2,262 | 16.63 |
| 7,000 | 0.0880 | 3,078 | 22.64 |
| 8,000 | 0.1005 | 4,021 | 30.14 |
| 10,000 | 0.1257 | 6,283 | 47.09 |

The brace shows the range of currents leading to overpressures between 2 and 15 mm Hg, sufficient to delay the boiling. It is to be understood that an equivalent result is obtained by 5000 ampere-turns by a single turn having a 5000 ampere current flowing therethrough or by a double turn in which flows a current of 2500 amperes, provided the distribution of the density of the current shall be of a sufficient uniformity in said turns. These numerical values are calculated on the assumption of L = 10 cm; the nature of the liquid metal does not interfere in this case.

3. Power

The necessary power across the generator 4 for feeding the inductor is equal to the product UI, wherein:

$$U = 1\ \omega l,\ 1 = \mu \frac{n^2 S}{L},\ l = \frac{BL}{\mu n}$$

$l$ is the self-inductance of the coil
S is the internal cross-section of the coil
$\omega$ is the angular frequency of the current
The magnitude range thereof may be determined by providing the following conditions:
$n = 1$ turn
I = 5000 A
L = 10 cm
D = 5 cm (diam. of the coil)
$f = 1000$ Hz.
There will be found:
$l = 25.10^{-9}$ H.
U = 0.8 V
UI = 4 kw.

The low value of this necessary power should be emphasized. The product UI represents a total power (active and reactive), but by associating capacitors to the inductor so as to improve the power factor thereof, it could be possible to feed said inductor from a source having a power of less than 1 kw.

The power calculated hereabove is that required for delaying the boiling. Obviously it would be possible to contemplate an inductor calculated not for delaying boiling with a minimum of power but, for instance, for delaying the boiling and reheating the liquid metal. In such a case it would be possible to use frequencies slightly above those defined above, in the range of 7,000 to 10,000 Hz and provide the apparatus with a power higher than the minimum required for controlling the degazing, the balance being used for reheating the liquid metal.

If switching, from unfavorable conditions contemplated above, to the following conditions:
I = 1,000 A
$f = 500$ Hz
it is found that a total power of 100 w shall be sufficient.

In summary the frequency of the current will be close to that expressed by the formula:

$$f = \frac{1}{\pi \mu \sigma R^2}$$

Orders of magnitude: 2,500 Hz for steels, and 500 Hz for aluminium.

The current which is necessary to lengthen the boiling front is close to 3,000 to 5,000 ampere-turns, independently of the nature of the liquid metal.

The necessary minimum power required is expressed by the formula:

$$P = U.I = \frac{2\ Sn^2 I^2}{\sigma L\ R^2}$$

Orders of magnitude: 10 kVA for steels, 2 kVA for aluminium.

It is advantageous to make provisions for modifying the frequency since it is this particular parameter which determines the shape of the boiling front; at low frequencies (for example of the order of 500 Hz) the induction penetrates well into the liquid metal and the front is accordingly fairly sharp; on the contrary, at relatively high frequencies (of about 5000 Hz) the skin effect is obvious and it confines the induced currents within a thin outer annulus so that an overpressure is established in the central area over the entire width thereof, thus reducing the output.

Figure 4:
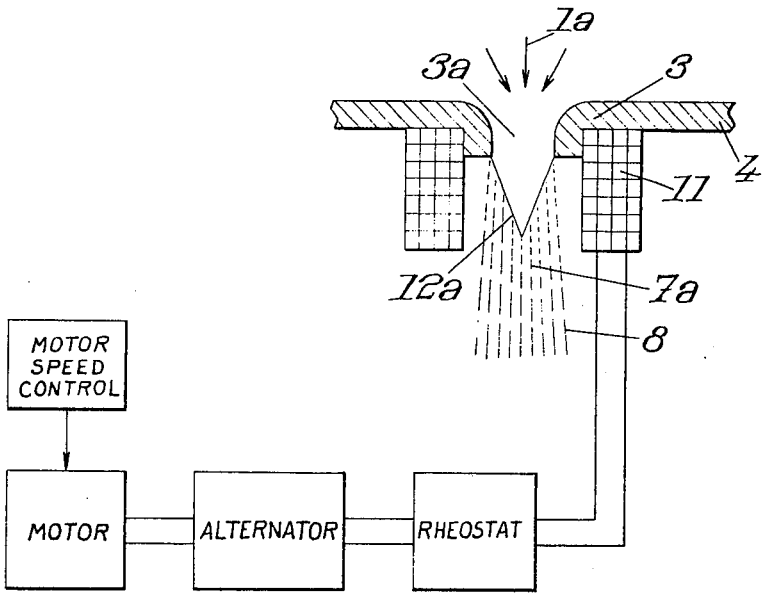
FIG. 4 is a schematic view in section showing the apparatus of this invention including means for modifying the frequency and intensity of the current.
Figure 5:
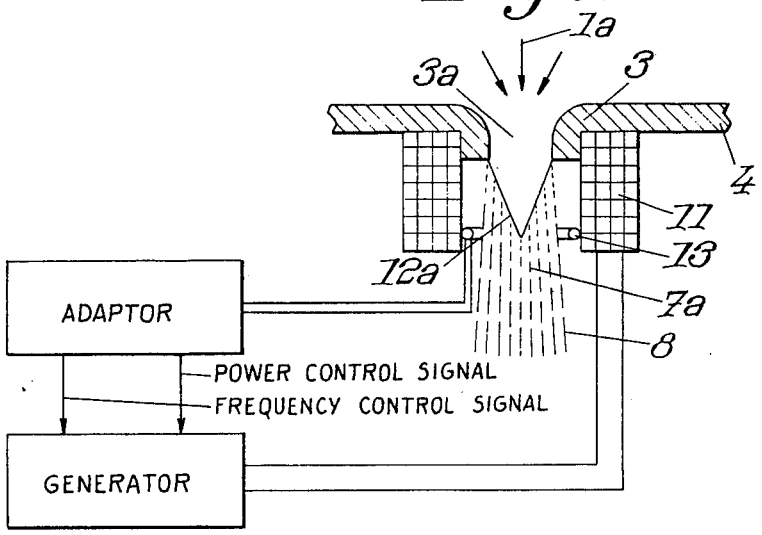
FIG. 5 is a schematic view in section showing another embodiment of the invention wherein the output signal of a coil means may be compared with set signal to control the position of the boiling front of the jet.

The improvements provided by the invention enable the following advantages to be achieved in relation to conventional methods of degasing liquid metals, especially liquid steel, by vacuum jet:

the dispersion and the burst of the jet are reduced and, if desired, controllable; indeed it is possible to decrease more or less the angle of jet dispersion by introducing a more or less substantial overpressure within the jet through variation of the frequency of the current applied to the solenoid;

the temperature drop of the jet is reduced owing to the production of heat by the Joule's effect in the liquid metal passing through the solenoid;

the necessary overpressure at the center of the jet is very low (and is equal to a few millimeters or a few centimeters of the height of metal, e.g. a few centimeters of steel); it does not require high values of magnetic induction of electric current; the required electric power is therefore not considerable;

the electromagnetic forces developed therein are sufficiently high and it is possible to control their distribution in the space, so that the geometry of the nozzle should have only a very low degree of repercution on the flow; it is thus possible to contemplate a technique in which the shape of the nozzle would not be limited in any way whatever and, in particular, the possibility of obtaining jets of equally good quality with eroded nozzles as with new and well-shaped nozzles;

the invention can be applied not only to steel but to other liquids such as aluminium and alloys thereof, while up to now the degasing technique by vacuum jets had only been usable for aluminium and its alloys;

the method and the apparatus provided with the improvements which are the subject matter of the present invention are highly flexible and can be adapted to various operational conditions by means of an easy control of the frequency and the intensity of the current applied to the solenoid; as may be seen in the embodiment of FIG. 4, the frequency is controlled by modifying the speed of the motor means driving the alternator which in turn feeds solenoid 11; the intensity of the current is controlled by the rheostat means;

it is possible to put the operation of the apparatus under the control of a set signal; thus, if it is desired that the boiling front should progress downstream of the nozzle at a length equal to a diameter, it will be sufficient to locate around the metal jet a small coil 13 (FIG. 5), the self-inductance of which varies in accordance with the shape of the central metal core, and said coil will emit a signal which can be compared with a set signal, thus obtaining the desired control. It is to be understood that the foregoing disclosure has been given merely by way of an example and that numerous changes can be made therein, the scope of the invention being only defined by the appended claims.

I claim:

1. Method for reducing the cooling of metal and the projections of metal onto the walls in the course of degassing of liquid metals by vacuum jet, which comprises establishing, (in the area of) around the nozzle spout feeding (extending) into the vacuum chamber and beneath said nozzle spout, a magnetic field tending to contract or confine the jet admitted by the nozzle spout into the vacuum chamber.

2. Apparatus for degassing by vacuum jet technique, comprising, around the nozzle spout which forms the jet between an upper ladle containing the liquid metal to be degassed and the vacuum chamber containing a lower ladle or an ingot mold to receive the degassed liquid metal and beneath said nozzle spout, alternating magnetic field producing means for inducing electric currents in the liquid metal to contract or confine the liquid metal jet ejected from said nozzle spout.

3. Apparatus according to claim 2 wherein said alternating magnetic field producing means includes a solenoid for having an a.c. electrical current flowing therethrough.

4. Apparatus according to claim 3 and further comprising means for modifying the frequency of the a.c. current flowing through said solenoid.

5. Apparatus according to claim 3, further comprising means for modifying the intensity of the a.c. current flowing through the solenoid.

6. Apparatus according to claim 3, wherein said liquid metal is liquid steel and the frequency of the current flowing through the solenoid is of the order of 2500 Hz.

7. Apparatus according to claim 3, wherein said liquid metal is liquid aluminium and the frequency of the current flowing through the solenoid is of the order of 500 Hz.

8. Apparatus according to claim 3, wherein, for controlling the dispersion of the jet without reheating the metal, the electric current flowing through the solenoid is such as to obtain about 3000 to 5000 ampere-turns.

9. Apparatus according to claim 3, wherein the metal is selected from the group of steel and aluminium and, for reheating the metal while controlling the dispersion of the jet, the frequency is set at a value higher than 2500 Hz for steel or respectively 500 Hz for aluminium and the number of ampere-turns is set at a value higher than 3000 to 5000 ampere-turns.

10. Apparatus according to claim 3, further comprising a small coil around the jet of metal and means for comparing the output signal of this coil to a set signal in order to control the position of the boiling front of the jet.

* * * * *